US012016434B1

(12) United States Patent
Nedelcu

(10) Patent No.: US 12,016,434 B1
(45) Date of Patent: Jun. 25, 2024

(54) FOOTWEAR COOLING SYSTEM

(71) Applicant: Cristian Andrei Nedelcu, Orange, CA (US)

(72) Inventor: Cristian Andrei Nedelcu, Orange, CA (US)

( * ) Notice: Subject to any disclaimer, the term of this patent is extended or adjusted under 35 U.S.C. 154(b) by 0 days.

(21) Appl. No.: 18/542,490

(22) Filed: Dec. 15, 2023

(51) Int. Cl.

| | |
|---|---|
| ***A43B 7/08*** | (2022.01) |
| ***A43B 3/48*** | (2022.01) |
| ***A43B 13/12*** | (2006.01) |
| ***A43B 17/00*** | (2006.01) |

(52) U.S. Cl.
CPC ..... *A43B 7/081* (2013.01); *A43B 3/48* (2022.01); *A43B 17/006* (2013.01)

(58) Field of Classification Search
None
See application file for complete search history.

(56) References Cited

U.S. PATENT DOCUMENTS

| | | | | |
|---|---|---|---|---|
| 4,078,321 | A * | 3/1978 | Famolare, Jr. | A43B 5/00 36/3 B |
| 6,041,518 | A * | 3/2000 | Polycarpe | A43B 7/34 36/3 R |
| 7,913,421 | B2 * | 3/2011 | Malenotti | A43B 7/081 36/131 |
| 8,209,882 | B2 * | 7/2012 | Leimer | A43B 7/081 36/3 R |
| 9,055,778 | B1 | 6/2015 | Kelley et al. | |
| 9,750,301 | B2 * | 9/2017 | Bier | A43B 23/0235 |
| 10,736,377 | B1 * | 8/2020 | Fotouhie | A43B 7/081 |
| 11,452,332 | B2 * | 9/2022 | Fujita | A43B 7/08 |
| 2003/0047301 | A1 * | 3/2003 | Ichigaya | A61F 7/0053 165/46 |
| 2005/0005473 | A1 * | 1/2005 | Oh | A43B 7/081 36/3 R |
| 2005/0235523 | A1 * | 10/2005 | Flechsig | A43B 13/182 36/3 R |
| 2009/0151203 | A1 * | 6/2009 | Boyer | A43B 7/082 36/3 R |

(Continued)

FOREIGN PATENT DOCUMENTS

| | | | | |
|---|---|---|---|---|
| CN | 107095388 | A * | 8/2017 | A43B 13/206 |

OTHER PUBLICATIONS

Seeed Fusion Open Parts Library, Latest Open Tech From Seeed, Powering Your IoT Projects with WiFi and Bluetooth-Enabled Microcontrollers, By Serena Liang, Apr. 28, 2023, 9 pages.

(Continued)

*Primary Examiner* — Jila M Mohandesi
(74) *Attorney, Agent, or Firm* — Lapple Ubell IP Law, LLP; Franklin D. Ubell

(57) ABSTRACT

A footwear cooling system includes a main airflow tube and first and second secondary air flow tubes positioned in respective air inlets in the front of a shoe. The first and second secondary air flow tubes join the main air flow tube at respective acute angles at a junction positioned a selected distance behind the main air inlet. The portion of the main airflow tube in front of the junction and the first and second secondary air flow tubes each have a plurality of air ducts formed on their side surfaces. The main air flow tube is connected to a fan which pulls air in from the main and secondary air inlets and exhausts air out of the rear of the shoe.

27 Claims, 9 Drawing Sheets

(56) References Cited

U.S. PATENT DOCUMENTS

| | | | | |
|---|---|---|---|---|
| 2010/0005687 | A1* | 1/2010 | Ramadoro (AN) .. | A43B 3/0042 36/29 |
| 2013/0019503 | A1* | 1/2013 | Vogt ..... | A43B 7/081 320/108 |
| 2014/0305009 | A1* | 10/2014 | Yeh ..... | A43B 7/088 36/103 |

OTHER PUBLICATIONS

Micro Connectors, Inc. Thermal Management, DigiKey RAS-FANHS1, https:/www.digikey.com/en/products/detail/micro-connectors-inc/RAS-FANHS10/12698346, Nov. 9, 2023, 3 pages.

* cited by examiner

FOOTWEAR COOLING SYSTEM

FIELD OF THE DISCLOSURE

The subject disclosure relates generally to footwear and more particularly to footwear with an internal cooling system designed to enhance comfort and performance and to control internal air flow to ensure a pleasant and breathable environment

DESCRIPTION OF RELATED ART

Footwear of various forms has been constructed in the past.

SUMMARY

According to the disclosure below, in an illustrative embodiment, a fan is mounted in a rear portion of a shoe. A main air inlet and first and second auxiliary air inlets are formed in a front portion of the shoe, while free air inlets are formed on opposite sides of a rear portion of the shoe.

A main airflow tube is positioned in the main air inlet, extends longitudinally down the interior of the shoe, and connects to the fan. First and second secondary air flow tubes are positioned in the first and second auxiliary air inlets and join the main air flow tube at respective acute angles at a junction positioned a selected distance behind the main air inlet. The portion of the main airflow tube in front of the junction and the first and second secondary air flow tubes each have a plurality of air ducts formed in respective side surfaces thereof. The fan functions to pull air in from the main air and secondary air inlets and exhaust it out of the rear of the shoe.

In one illustrative embodiment, respective rows of air ducts are formed on opposite sides of the front portion of the main air flow tube and on opposite sides of each of the first and second auxiliary air flow tubes. The air ducts could be arranged in other manners or irregularly disposed rather than arranged in rows in other embodiments.

In one embodiment, a mesh screen insole may be placed on top of the main and first and second secondary air flow channels. Such an embodiment may also include a fabric insole place on top of the mesh screen insole.

Other illustrative embodiments include a method of constructing an airflow system for footwear comprising forming a main airflow tube of a length selected to extend longitudinally down the interior of the footwear, joining first and second secondary air flow tubes to the main air flow tube at respective acute angles at a junction positioned a selected distance behind a front end of the main airflow tube, selecting a cross-section of each secondary air flow tube to be smaller than that of the main air flow tube, and forming a plurality of air ducts on a side surface of the main air flow tube and on respective side surfaces of each of the secondary air flow tubes. The method may further comprise connecting a back end of the main air flow tube to a fan and configuring the fan to draw air through the main and secondary air flow tubes.

According to another aspect of the disclosure, a method is provided comprising installing a fan in a rear portion of a shoe, installing an air flow control system in the shoe connected to the fan, and configuring the air flow control system to include a plurality of tubes arranged to intake air from a front portion of the shoe and circulate it beneath a wearer's foot.

DETAILED DESCRIPTION

An illustrative embodiment of an air flow cooled shoe 11 is shown in FIGS. 1-9. The shoe 11 may include an upper 14 attached to a sole 16, which may be formed of various suitable layers in various embodiments. The shoe 11 may be a conventional "sneaker" of high top or low top form or various other forms of shoes such as athletic shoes, casual shoes, dress shoes, boots or specialized sport shoes.

Figure 1:
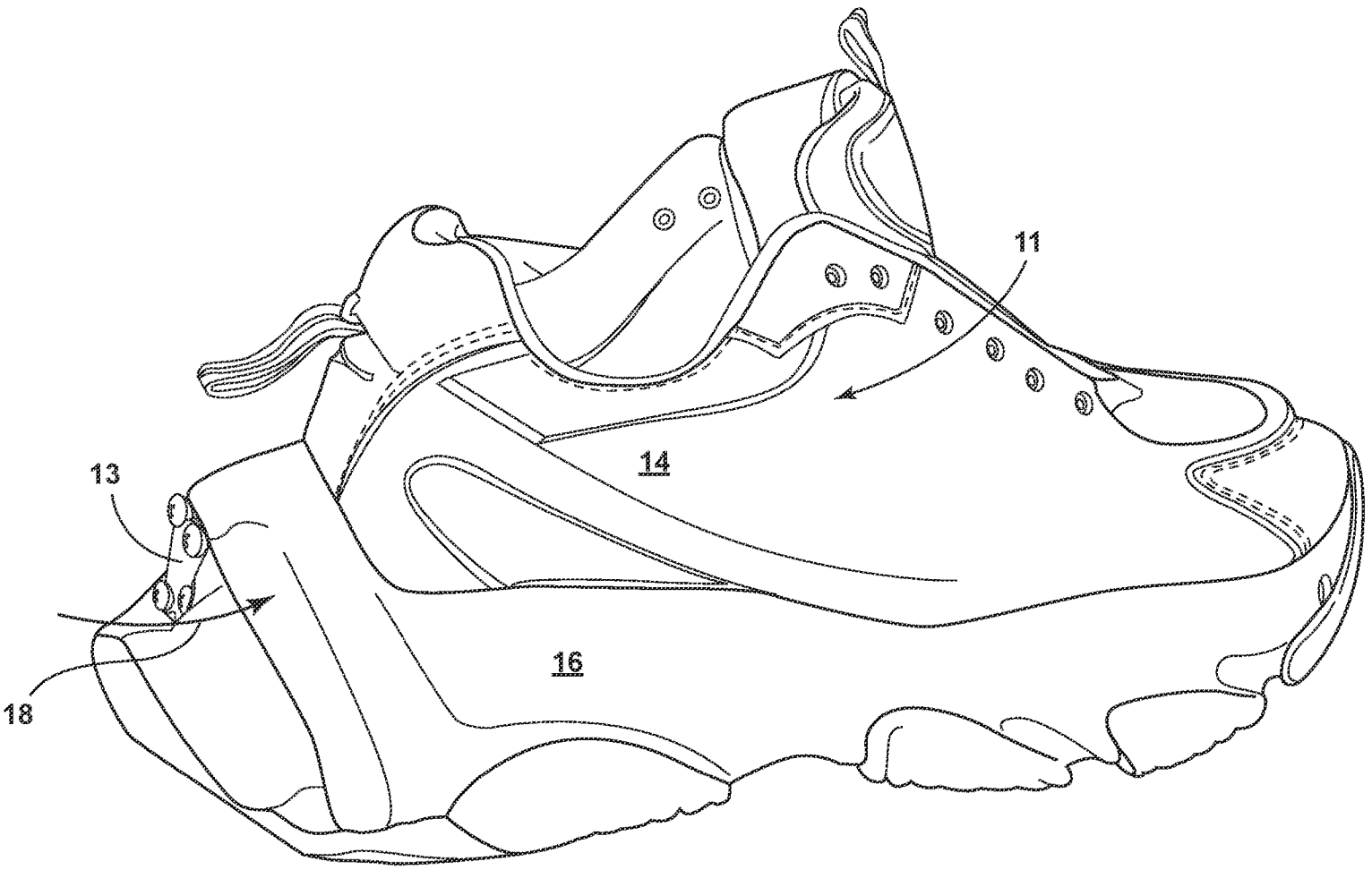
FIG. 1 is a perspective view of a shoe employing an air flow system according to an illustrative embodiment.
Figure 2:
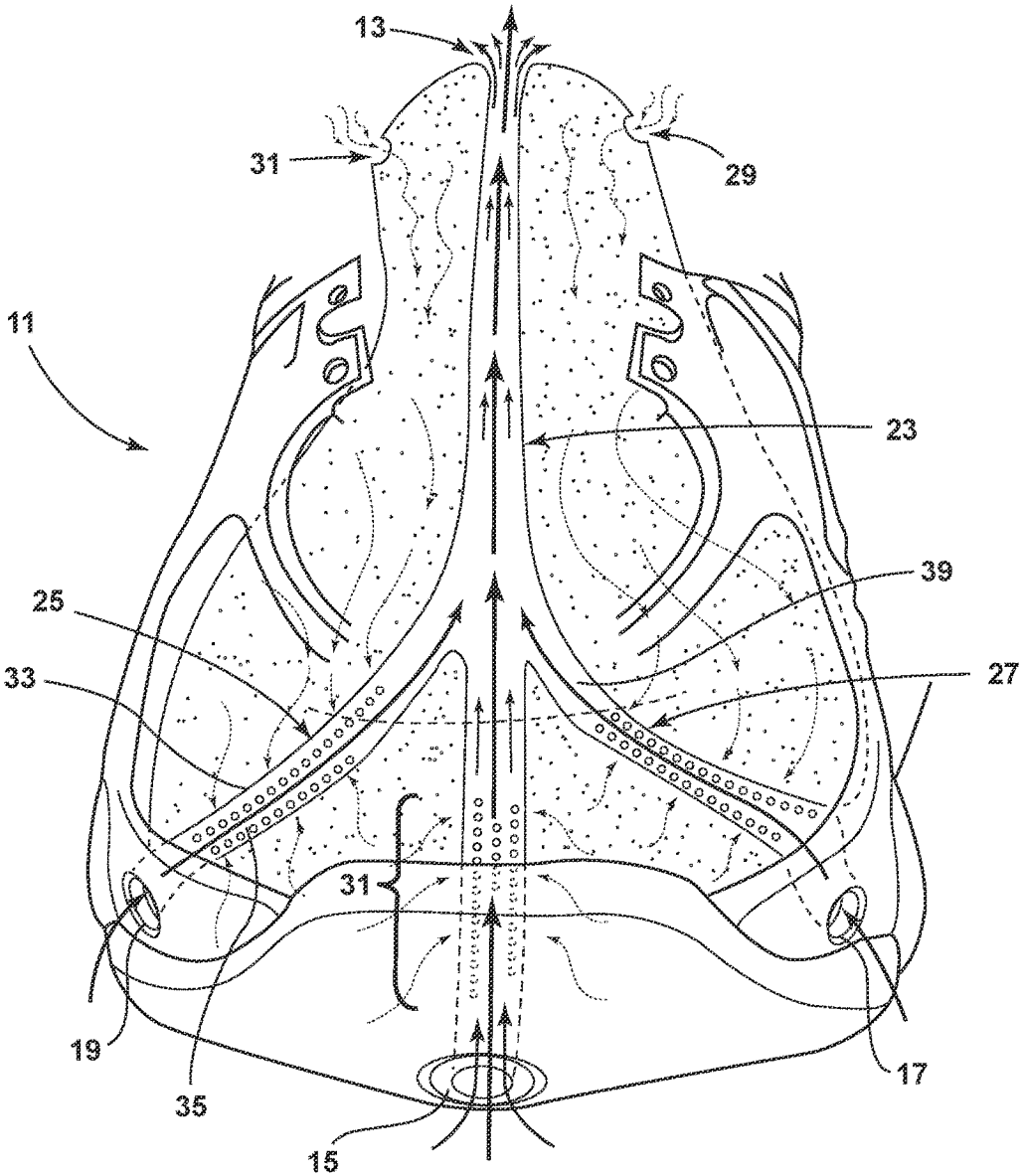
FIG. 2 is a partial broken away front view of the shoe of FIG. 1.
Figure 3:
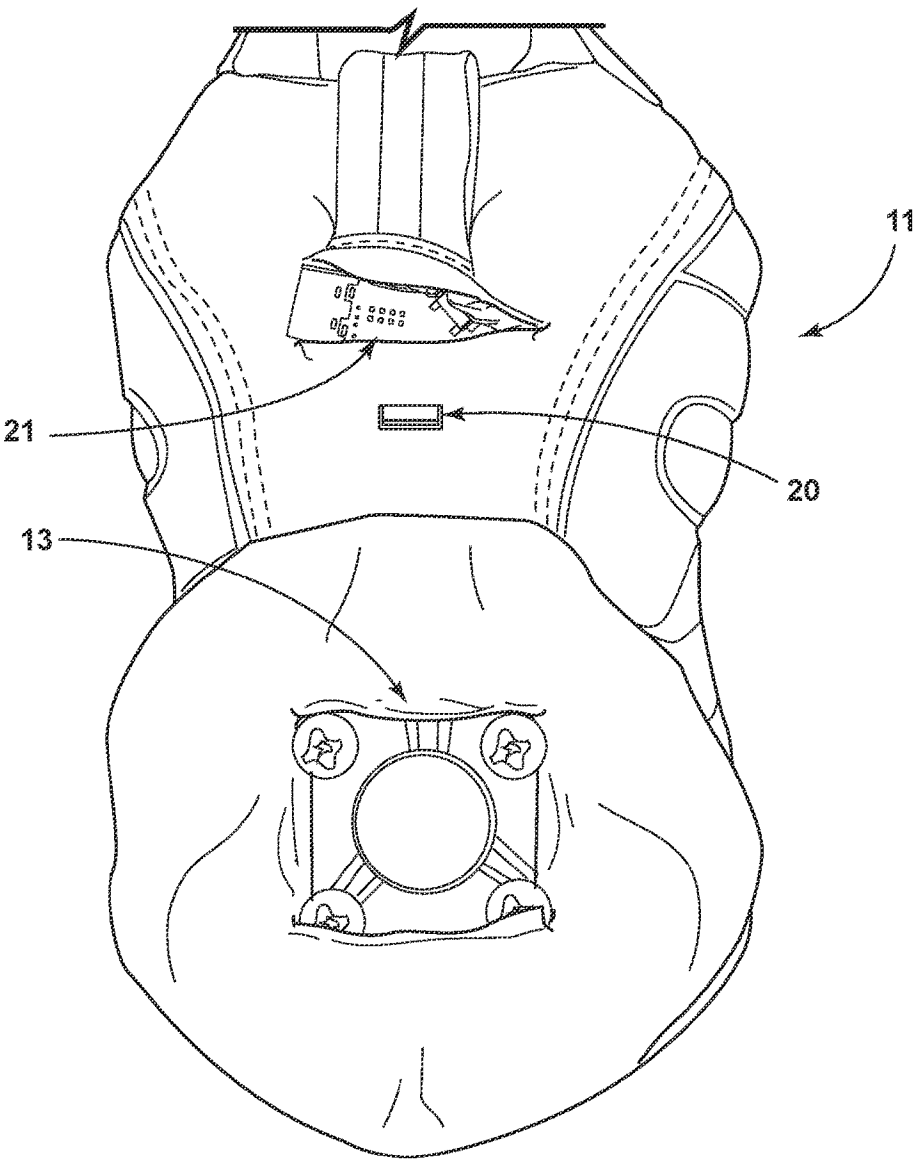
FIG. 3 is a rear view of the shoe of FIG. 1.

As shown, for example, in FIGS. 1-3, a turbo fan 13 and a control switch 21 are mounted in a rear portion 18 of the shoe 11, while a main air inlet 15 and first and second auxiliary air inlets 17, 19 are formed in the front or toe of the shoe 11. In the illustrative embodiment, the air inlets 15, 17, 19 supply an internal air flow system illustrated in further detail in FIG. 4

Figure 4:
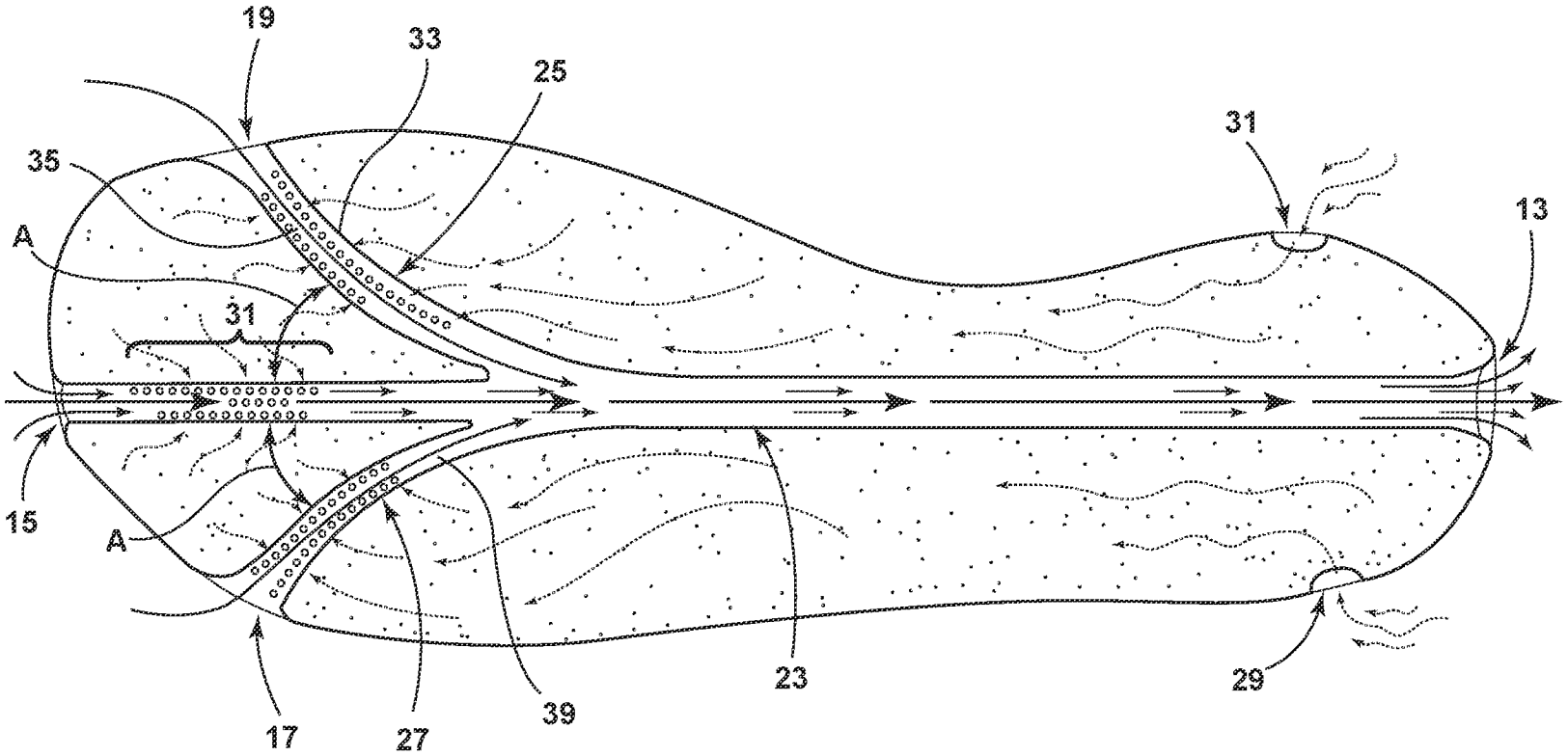
FIG. 4 is a top view schematic diagram further illustrating the structure and operation of the shoe of FIG. 1.
Figure 5:
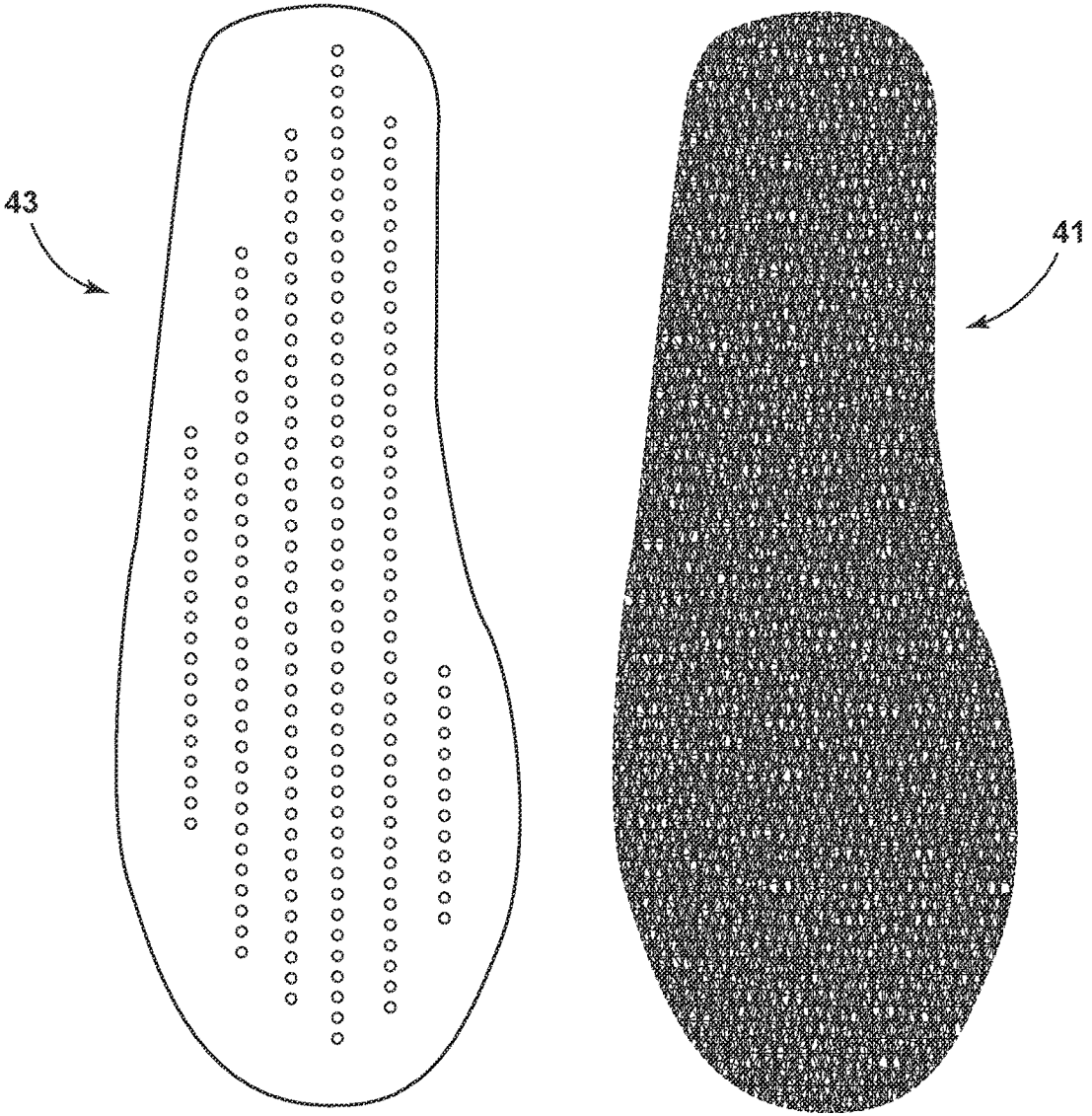
FIG. 5 is a top view of showing mesh and fabric insole layers according to an illustrative embodiment.
Figure 6:
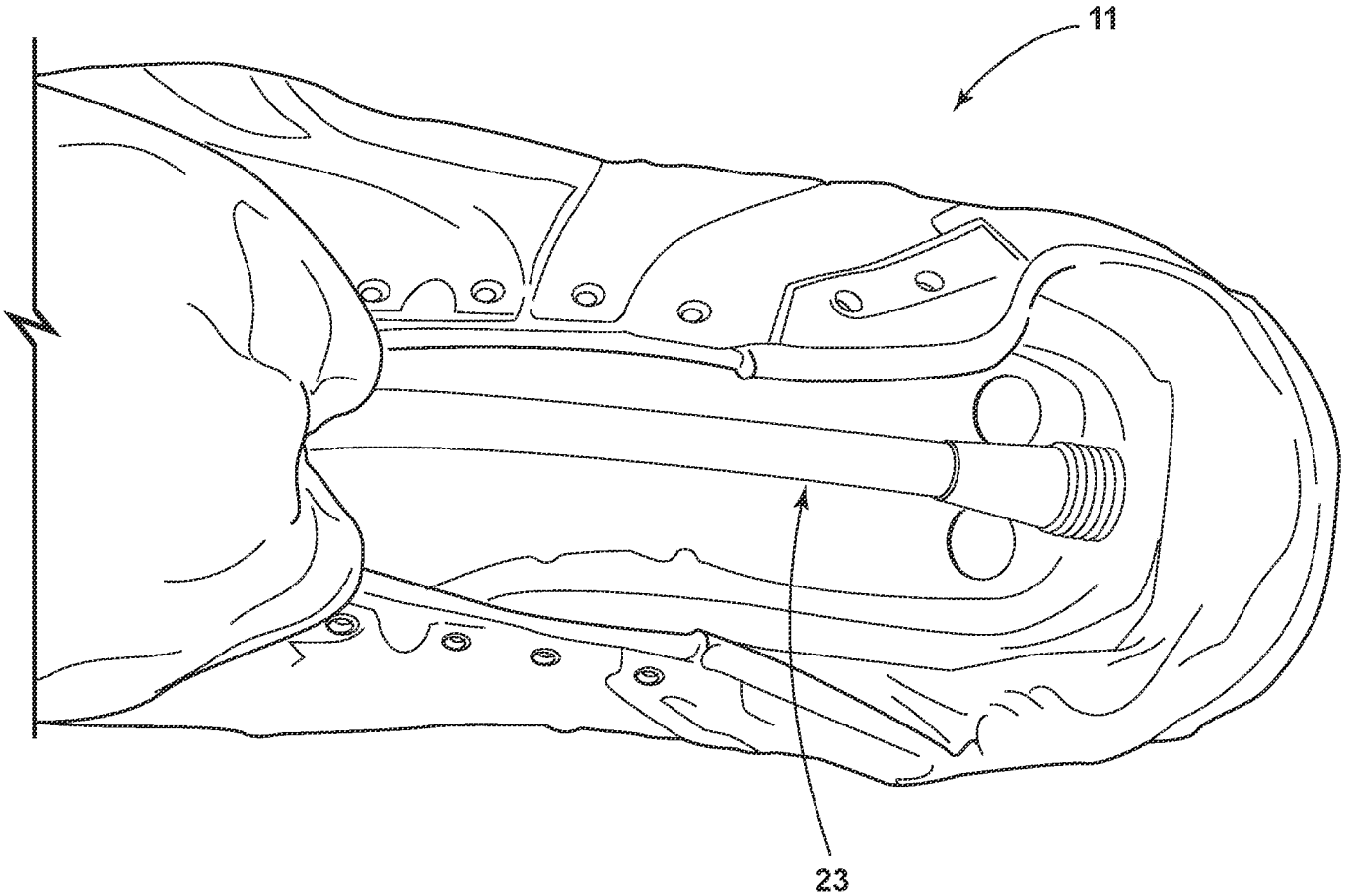
FIG. 6 is a top perspective view illustrating a rear portion of the air tube structure.

As shown in FIG. 4, a main airflow tube 23 is positioned in the main air inlet 15, extends longitudinally down the middle of the interior of the shoe 11, and connects to the turbo fan 13. First and second secondary air flow tubes 25, 27 are positioned in the auxiliary air inlets 17, 19 curve inwardly slightly and join the main air flow channel 23 at respective acute angles "A" of, for example, 30 to 45 degrees. In the illustrative embodiment, the first and second secondary air flow channels 25, 27 have rows 33, 35; 37, 39 of equally spaced perforations formed on opposite sides thereof, which act as air ducts, as does a front portion 31 of the main tube 23. In various embodiments, the perorations may be in the range of 1/16 to 1/8 inch or 1.5 to 2.5 mm in diameter. Free air flow vents 29, 31 are formed in the rear of the shoe 11 near the turbo fan 13. These vents 29 may be 1/4 inch in diameter in an illustrative embodiment, but, as with other dimensions herein may vary in various embodiments. The turbo fan 13 is configured to pull air in from the main air inlet 15 and secondary air inlets 17, 19 and exhaust it out of the rear of the shoe 11.

Figure 10:
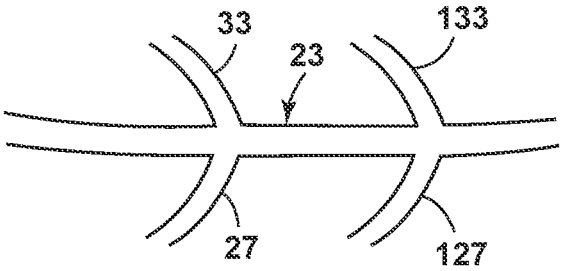
FIG. 10 is a schematic diagram illustrating an alternate air flow tube embodiment.

In an illustrative embodiment, the air flow tubes 15, 17, 19 are flexible plastic tubes having circular cross-sections. The inside diameter of the main tube 15 is greater than the inside diameters of the secondary tubes 17, 19 and in one embodiment may be, for example, 3/8 inch for the main tube 15 and 1/4 inch each for the secondary tubes 17, 19. The tubes 15, 17, 19 may have other inside diameters in other embodiments. The tubes may also have other cross-sections in other embodiments, for example, rectangular or elliptical. While the secondary tubes 17, 19 are shown joining the main tube 15 at the same point, they could join at different points in other embodiments although joinder at the same point is preferred. In larger shoes, it may be desirable to add a second pair of secondary tubes 127, 133 as illustrated schematically in FIG. 10. Additionally, while pairs of tubes are preferred, a single secondary tube joining the main tube could also be employed, thus contemplating at least one secondary air flow tube.

Figure 11:
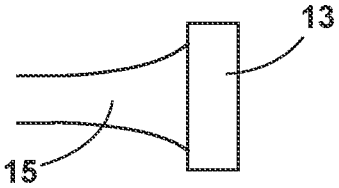
FIG. 11 is a partial side view illustrating the interface between the main tube and fan of the illustrative embodiment.

The air tube structure comprising tubes 15, 17, 19 is preferably formed as a single piece component, for example by casting, 3D printing, or polyurethane injection molding to ensure that the inside tube walls at the junction between the main and secondary tubes has a very smooth surface and transition to assist the air flow in maintaining a laminar trajectory. Once formed, the single piece tube component can be cast into the shoe sole during initial fabrication or alternately glued or otherwise fastened into complementary mating semicircular channels formed in the sole of the shoe. In one embodiment, the main tube 15 expands at the end to join with the fan 13, as illustrated schematically in FIG. 11.

Air flow within the shoe is illustrated by the arrows in FIG. 4. In operation, air is sucked in through air inlets 15, 17, 19 and exits out the turbo fan 13. At the same time, a vacuum effect is created at the rear of the shoe 11 causing air drawn in through the free air inlets 29, 31 to flow outside of the main tube 15 forward through the perforations 33, 35; 35,37 and into the first and second auxiliary channels 25, 27. Additionally, the particular structure of the air flow tubes of the illustrative embodiment is believed to impart a Coanda effect and serves to increase the volume of air flow through the tubes. The system ensures a comfortable microclimate inside the shoe 11, preventing overheating, perspiration, and odor.

Figure 7:
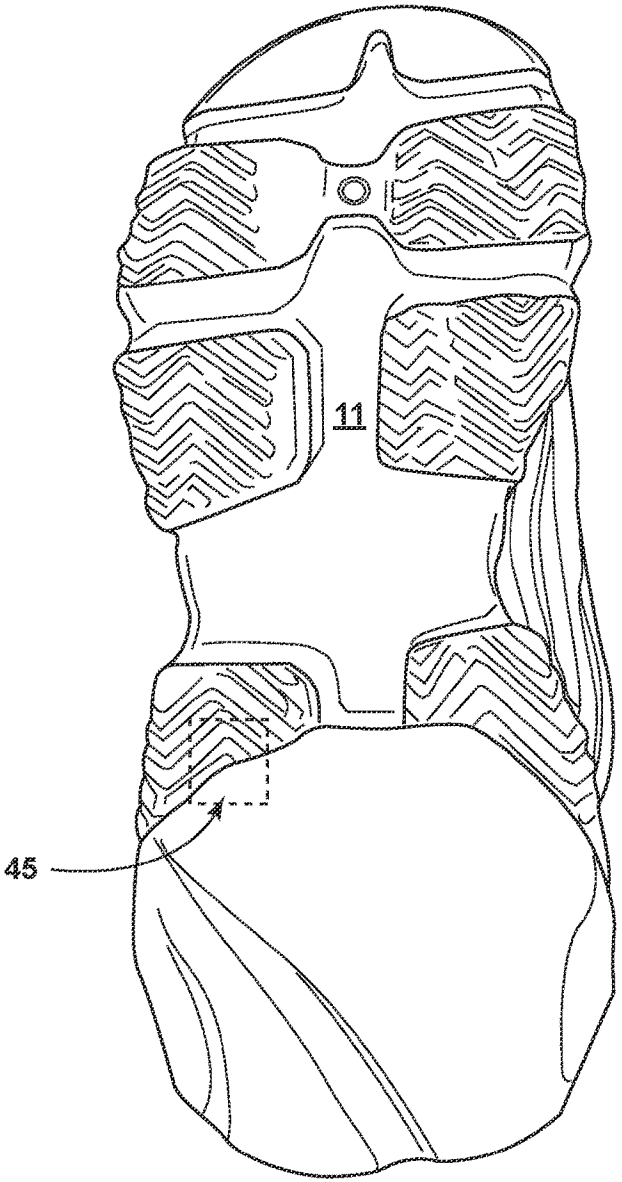
FIG. 7 is a bottom view of the shoe of FIG. 1.
Figure 8:
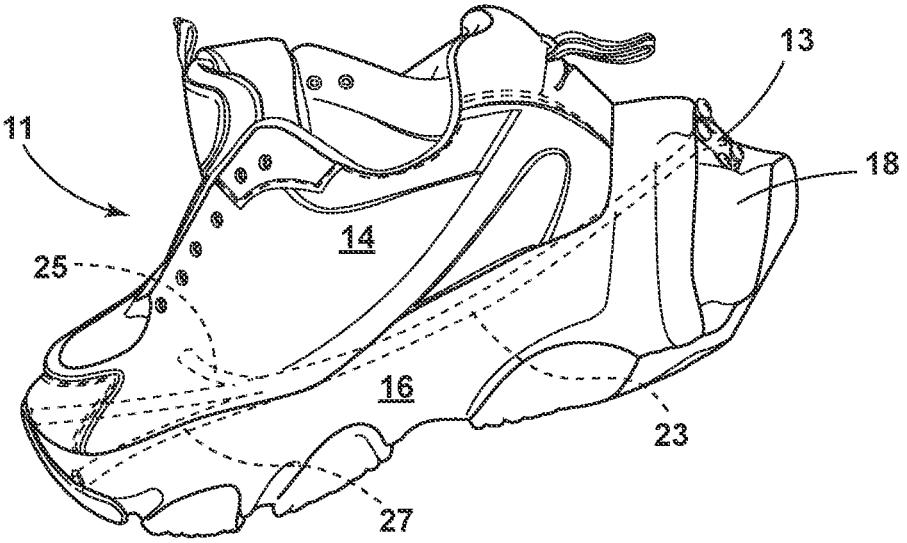
FIG. 8 is a perspective view of the shoe of FIG. 1.
Figure 9:
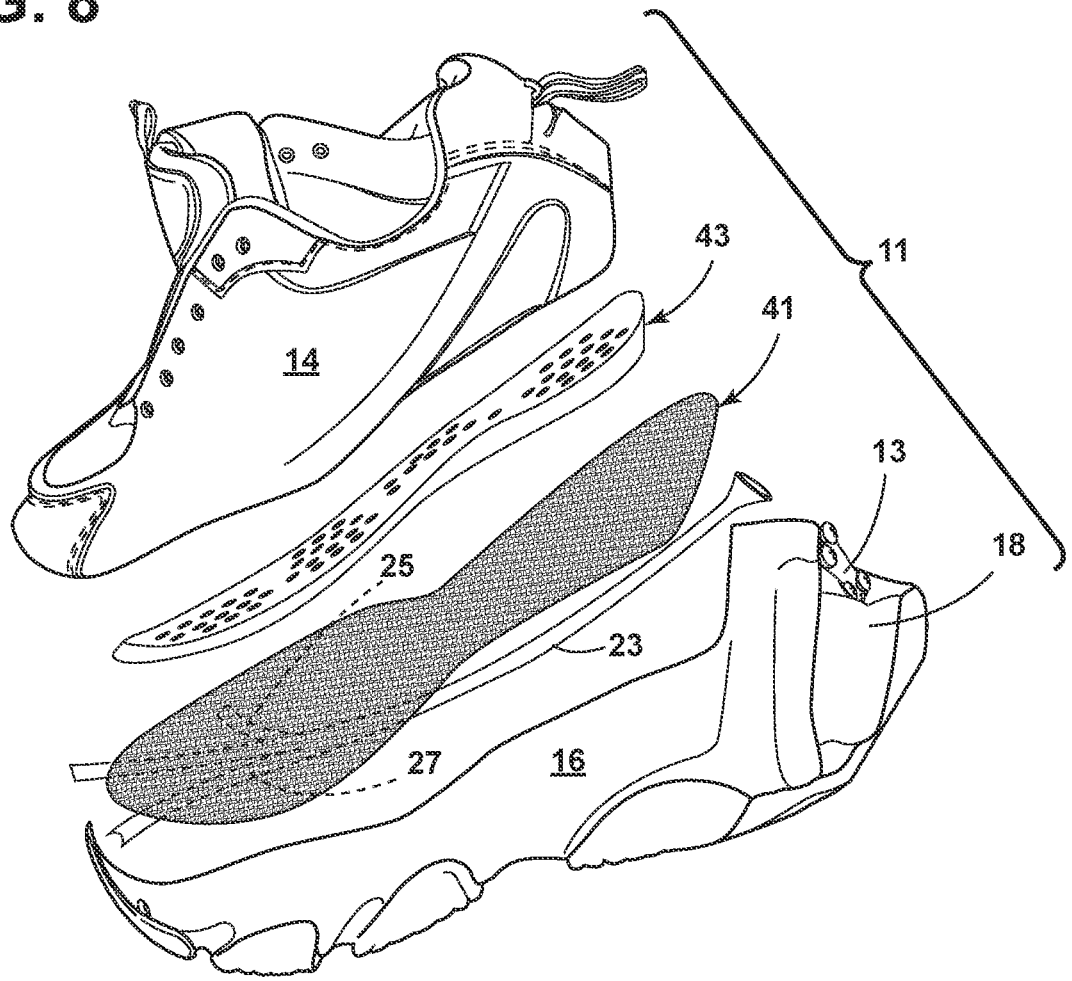
FIG. 9 is an exploded perspective view of the shoe of FIG. 1.

In one illustrative embodiment, the turbo fan 13 may be Part Number RAS-FANHS10 as made by Micro Connectors, Inc., Hayward, California, which has a full speed cooling mode and quiet cooling mode. The fan 13 may be molded into the shoe, cast, or attached by mechanical fasteners. The control switch 21 may be manually activated to turn the fan 13 on and off and to select one of two or more speeds of operation. In one embodiment, the control switch 21 may be concealed, for example, behind a thin layer of material. In one embodiment, the fan 13 is powered by a 5-volt lithium battery 45, which, for example, may be embedded in the bottom of the sole of the shoe 11 as shown in FIG. 7 and arranged for USB or inductive charging. FIG. 3 illustrates a Type C charging plug 20 for the battery 45.

Figure 12:
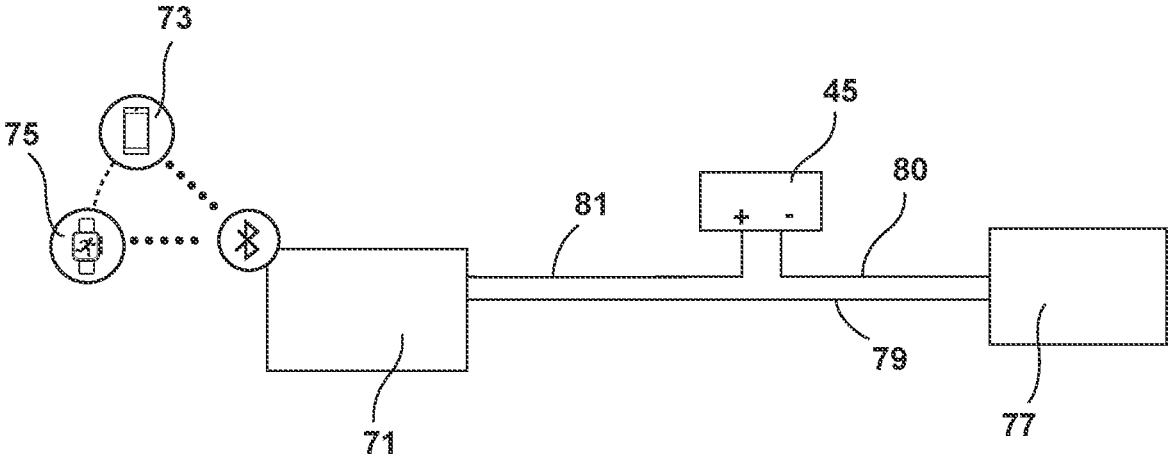
FIG. 12 is an electrical circuit diagram illustrating fan control circuitry according to an illustrative embodiment.

In another embodiment shown in FIG. 12, a Bluetooth enabled microcontroller 71 may be wirelessly controlled, for example, from a smart phone 73 or smart watch 75 to provide on-off control of a fan 77. In one embodiment the fan 77 may be a variable speed fan, and the controller 71 may be used to select the speed of operation of the fan 77. In one embodiment, the microcontroller 71 can be installed in the position of the switch 21 with the electrical leads 79, 80, 81 suitably routed through the shoe structure.

In one illustrative embodiment, the tubes 23, 25, 27 are covered by a mesh screen insole 41 and a perforated cotton fabric insole 43 (FIG. 5) placed on top of the mesh insole 41. The mesh insole 41 may be an aluminum or inox aluminum filter that consists primarily of layers of aluminum slit and expanded into mesh of differing densities. In one embodiment, the aluminum material is made of many layers of tiny baffles bonded together. The mesh insole 41 functions to ensure a flexible gap between the foot and the holes in the air flow tubes and allows air to circulate under pressure of the foot. In illustrative embodiments, the thickness of the mesh insole 41 may be 0.1 or 0.2 inches, but may be other thicknesses in other embodiments.

From the foregoing, those skilled in the art will appreciate that various adaptations and modifications of the just described illustrative embodiments can be configured without departing from the scope and spirit of the invention Therefore, it is to be understood that, within the scope of the appended claims, the invention may be practiced other than as specifically described herein

What is claimed is:

1. An apparatus comprising:
- a fan mounted in a rear portion of a shoe;
- a main air inlet and first and second auxiliary air inlets formed in a front portion of the shoe;
- a main airflow tube positioned in the main air inlet and extending longitudinally down the interior of the shoe and connected to the fan;
- first and second secondary air flow tubes positioned in the first and second auxiliary air inlets;
- the first and second secondary air flow tubes joining the main air flow tube at respective acute angles at a junction positioned a selected distance behind the main air inlet, the portion of the main airflow tube in front of the junction and the first and second secondary air flow tubes each having a plurality of air ducts formed on respective side surfaces thereof; and
- the fan being configured to pull air in from the main air inlet and the first and second secondary air inlets and exhaust air out of the rear of the shoe.

2. The apparatus of claim 1 wherein the portion of the main air flow tube in front of the junction has a plurality of air ducts formed on opposite sides thereof.

3. The apparatus of claim 1 wherein the first and second secondary air flow channels each have a plurality of air ducts formed on opposite sides thereof.

4. The apparatus of claim 1 further comprising first and second rows of air ducts formed on opposite sides of the portion of the main air flow tube in front of the junction.

5. The apparatus of claim 4 wherein the first and second secondary air flow tubes each have respective first and second rows of air ducts formed on opposite sides thereof.

6. The apparatus of claim 1 further comprising first and second free air inlets formed in a rear portion of the shoe.

7. The apparatus of claim 1 further comprising a mesh screen insole placed on top of the main and first and second secondary air flow tubes.

8. The apparatus of claim 7 further comprising a fabric insole positioned above the mesh screen insole.

9. The apparatus of claim 1 wherein the secondary air flow tubes each have a diameter which is less than a diameter of the main air flow tube.

10. The apparatus of claim 9 wherein the diameter of each of the secondary air flow tubes is ¼ inch and the diameter of the main air flow tube is ⅜ inch.

11. The apparatus of claim 1 further comprising a Bluetooth enabled controller configured to control the fan.

12. A method of constructing an airflow system for an item of footwear comprising:
- forming a main airflow tube of a length selected to extend longitudinally down the interior of the item of footwear;
- joining first and second secondary air flow tubes to the main air flow tube at respective acute angles at a junction positioned a selected distance behind a front end of the main airflow tube;

forming a cross-section of each of the secondary air flow tubes to be smaller than a cross-section of the main air flow tube; and forming a plurality of air ducts on a side surface of the main air flow tube and on respective side surfaces of each of the first and second secondary air flow tubes.

13. The method of claim 12 further comprising connecting a back end of the main air flow tube to a fan.

14. The method of claim 13 further comprising employing a Bluetooth enabled controller to control functioning of the fan.

15. An apparatus comprising:

a fan mounted in a rear portion of a shoe;

a main air inlet and first and second auxiliary air inlets formed in a front portion of the shoe;

a main airflow tube positioned in the main air inlet and extending longitudinally down the interior of the shoe and connected to the fan;

first and second secondary air flow tubes positioned in the first and second auxiliary air inlets;

the first and second secondary air flow tubes joining the main air flow tube at respective acute angles at a junction positioned a selected distance behind the main air inlet, the portion of the main airflow tube in front of the junction and the first and second secondary air flow tubes each having a plurality of air ducts formed on respective side surfaces thereof;

the fan being configured to pull air in from the main air inlet and the first and second secondary air inlets and exhaust air out of the rear of the shoe; and wherein a portion of each of the main air flow tube and secondary air flow tubes lie above a topmost surface of the sole of the shoe and wherein the plurality of air ducts in each of the first and second secondary air flow tubes are formed in the portion of those tubes lying above the topmost surface of the sole, thereby enabling air to circulate in the shoe above said topmost portion.

16. The apparatus of claim 15 wherein the portion of the main air flow tube above the topmost portion of the shoe and in front of the junction has a plurality of air ducts formed on opposite sides thereof.

17. The apparatus of claim 16 wherein the plurality of ducts in the main air flow tube comprise first and second rows of air ducts formed on opposite sides of the main air flow tube.

18. The apparatus of claim 16 wherein the main air flow tube and first and second secondary air flow tubes and the air ducts formed therein are configured to cause air circulation above the topmost surface of the sole from the rear of the shoe towards the front of the shoe.

19. The apparatus of claim 15 wherein the air ducts in the first and second secondary air flow channels are each formed on opposite sides of the respective first and second secondary air flow channels.

20. The apparatus of claim 15 further comprising at least one free air inlet formed in a rear portion of the shoe.

21. The apparatus of claim 15 further comprising a mesh screen insole placed on top of the main and first and second secondary air flow tubes in a position below that of a wearer's foot.

22. The apparatus of claim 21 further comprising a fabric insole positioned above the mesh screen insole in a position below that of a wearer's foot.

23. The apparatus of claim 15 wherein the secondary air flow tubes each have a diameter which is less than a diameter of the main air flow tube.

24. The apparatus of claim 23 wherein the diameter of each of the secondary air flow tubes is ¼ inch and the diameter of the main air flow tube is ⅜ inch.

25. A method of constructing an airflow system for an item of footwear comprising:

forming a main airflow tube of a length selected to extend longitudinally down the interior of the item of footwear and such that a portion thereof lies above a topmost portion of the sole of the item of footwear;

joining first and second secondary air flow tubes to the main air flow tube at respective acute angles at a junction positioned a selected distance behind a front end of the main airflow tube and such that a portion of each of the first and second air flow tubes lies above a topmost portion of the sole of the item of footwear; and forming a plurality of air ducts on a surface of the main air flow tube which lies above the topmost portion of the sole and on respective surfaces of each of the first and second secondary air flow tubes which lie above the topmost portion of the sole.

26. The method of claim 25 further comprising connecting a back end of the main air flow tube to a fan.

27. The method of claim 25 further comprising configuring the main air flow tube and first and second secondary air flow tubes and the air ducts formed in each of said air flow tubes so as to cause air circulation within the item of footwear above the topmost surface of the sole from a rear portion of the item of footwear towards a front portion thereof.

* * * * *